US011393382B2

(12) United States Patent
Hong et al.

(10) Patent No.: US 11,393,382 B2
(45) Date of Patent: Jul. 19, 2022

(54) DISPLAY DEVICE LUMINANCE COMPENSATING APPARATUS, DISPLAY SYSTEM INCLUDING THE SAME, AND METHOD OF COMPENSATING LUMINANCE BASED ON AN EXPECTED CORRECTION GRAY LEVEL

(71) Applicant: Samsung Display Co., Ltd., Yongin-Si (KR)

(72) Inventors: Seok Ha Hong, Yongin-si (KR); Dong Joon Kwag, Yongin-si (KR); Hyung Jin Kim, Yongin-si (KR); Hye Sang Park, Yongin-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 17/152,629

(22) Filed: Jan. 19, 2021

(65) Prior Publication Data

US 2021/0383736 A1 Dec. 9, 2021

(30) Foreign Application Priority Data

Jun. 9, 2020 (KR) ..... 10-2020-0069608

(51) Int. Cl.
*G09G 3/20* (2006.01)

(52) U.S. Cl.
CPC ... *G09G 3/2007* (2013.01); *G09G 2320/0626* (2013.01); *G09G 2320/0673* (2013.01); *G09G 2360/145* (2013.01)

(58) Field of Classification Search
None
See application file for complete search history.

(56) References Cited

U.S. PATENT DOCUMENTS

2019/0130872 A1* 5/2019 Furihata ..... G09G 3/3208
2020/0160801 A1* 5/2020 Wang ..... G09G 3/3648

FOREIGN PATENT DOCUMENTS

KR 10-0618190 B1 9/2006
KR 10-1981137 B1 8/2019

* cited by examiner

*Primary Examiner* — Chad M Dicke
(74) *Attorney, Agent, or Firm* — Innovation Counsel LLP

(57) ABSTRACT

A luminance compensating apparatus includes a luminance characteristic value calculator calculating a first luminance characteristic value corresponding to a first unit section between first and second reference gray levels, and a second luminance characteristic value corresponding to a second unit section between second and third reference gray levels based on a first luminance value, a second luminance value, and a third luminance value; an expected correction gray level calculator calculating an expected correction gray level corresponding to the first reference gray level based on the first luminance value; and a compensation gray level calculator calculating a gamma compensation value based on the first luminance characteristic value when the expected correction gray level is included in the first unit section, and based on the first luminance characteristic value and the second luminance characteristic value when the expected correction gray level is included in the second unit section.

16 Claims, 9 Drawing Sheets

FIG. 8A

Table 1

| Imaging Gray Level (Reference Gray Level) | 32 | 64 | 96 | 128 | 196 | 224 |
|---|---|---|---|---|---|---|
| Gray Level to be corrected | 32 | 64 | 96 | 128 | 196 | 224 |

FIG. 8B

Table 2

| Imaging Gray Level (Reference Gray Level) | 16 | 32 | 64 | 96 | 128 | 196 | 224 | 240 |
|---|---|---|---|---|---|---|---|---|
| Gray Level to be corrected | – | 32 | 64 | 96 | 128 | 196 | 224 | – |

DISPLAY DEVICE LUMINANCE COMPENSATING APPARATUS, DISPLAY SYSTEM INCLUDING THE SAME, AND METHOD OF COMPENSATING LUMINANCE BASED ON AN EXPECTED CORRECTION GRAY LEVEL

CROSS-REFERENCE TO RELATED APPLICATION

The application claims priority to and the benefit of Korean Patent Application No. 10-2020-0069608, filed Jun. 9, 2020, the disclosure of which is hereby incorporated by reference in its entirety.

BACKGROUND

Field

The present disclosure relates to a luminance compensating apparatus for providing optical compensation of a display panel, a display system including the same, and a method of compensating luminance for a display panel.

Discussion

During the manufacture of a display device, an inspection process may be performed for detecting a display unevenness on the display panel such as Mura effects. If the display unevenness is detected during the inspection process, the corresponding display panel may undergo a luminance compensation process for compensating luminance of the display unevenness.

As an example of the luminance compensation process, an optical compensation process may be employed. According to the optical compensation process, a predetermined image is displayed on the display panel, the image displayed on the display panel is captured using a camera or the like, and the captured image is analyzed to compensate for luminance of the display unevenness.

SUMMARY

The present disclosure provides a luminance compensating apparatus capable of improving display quality by accurately calculating a gamma compensation value for optical compensation.

A luminance compensating apparatus according to an embodiment of the present disclosure may include: a luminance characteristic value calculator calculating a first luminance characteristic value corresponding to a first unit section between a first reference gray level and a second reference gray level, and a second luminance characteristic value corresponding to a second unit section between the second reference gray level and a third reference gray level based on at least one or more of a first luminance value corresponding to the first reference gray level, a second luminance value corresponding to the second reference gray level that is greater than the first reference gray level, and a third luminance value corresponding to the third reference gray level that is greater than the second reference gray level; an expected correction gray level calculator calculating an expected correction gray level corresponding to the first reference gray level based on the first luminance value; and a compensation gray level calculator calculating a gamma compensation value and a first compensation gray level corresponding to the first reference gray level based on the gamma compensation value and the expected correction gray level. The compensation gray level calculator may calculate the gamma compensation value based on the first luminance characteristic value in a first case where the expected correction gray level is included in the first unit section, and calculate the gamma compensation value based on the first luminance characteristic value and the second luminance characteristic value in a second case where the expected correction gray level is included in the second unit section.

In an embodiment, in the second case, the compensation gray level calculator may calculate the gamma compensation value by a first equation of:

$$\gamma t = \frac{\gamma 2 \cdot \ln(gt/g2) + \gamma 1 \cdot (g2/g1)}{\ln(gt/g1)}$$

wherein γt may represent the gamma compensation value, γ1 may represent the first luminance characteristic value, γ2 may represent the second luminance characteristic value, g1 may represent the first reference gray level, g2 may represent the second reference gray level, and gt may represent the expected correction gray level.

In an embodiment, the luminance characteristic value calculator may calculate the first luminance characteristic value based on the first luminance value and the second luminance value, and the second luminance characteristic value based on the second luminance value and the third luminance value.

In an embodiment, the luminance characteristic value calculator may calculate the first luminance characteristic value and the second luminance characteristic value by a second equation of:

$$\gamma 1 = \frac{\ln(L1/L2)}{\ln(g1/g2)},\ \gamma 2 = \frac{\ln(L2/L3)}{\ln(g2/g3)}$$

wherein γ1 may represent the first luminance characteristic value, γ2 may represent the second luminance characteristic value, L1 may represent the first luminance value, L2 may represent the second luminance value, L3 may represent the third luminance value, g1 may represent the first reference gray level, g2 may represent the second reference gray level, and g3 may represent the third reference gray level.

In an embodiment, the expected correction gray level calculator may calculate a luminance compensation ratio based on a difference between the first luminance value and a first luminance target value that corresponds to the first reference gray level.

In an embodiment, the expected correction gray level calculator may calculate the luminance compensation ratio by a third equation of:

$$LCR = \frac{LT - L1}{L1}$$

wherein LCR may represent the luminance compensation ratio, LT may represent the first luminance target value, and L1 may represent the first luminance value.

In an embodiment, the expected correction gray level calculator may calculate the expected correction gray level by a fourth equation of:

$$gt = g1 \times (1 + LCR)^{1/22}$$

wherein gt may represent the expected correction gray level, g1 may represent the first reference gray level, and LCR may represent the luminance compensation ratio.

In an embodiment, the compensation gray level calculator may calculate the first compensation gray level by a fifth equation of:

$$gcv = g1 \times (LCR)^{\frac{1}{\gamma t}}$$

wherein gcv may represent the first compensation gray level, g1 may represent the first reference gray level, LCR may represent the luminance compensation ratio, and γt may represent the gamma compensation value.

In an embodiment, the luminance characteristic value calculator may further calculate a third luminance characteristic value corresponding to a third unit section between the third reference gray level and a fourth reference gray level based on the third luminance value and a fourth luminance value corresponding to the fourth reference gray level that is greater than the third reference gray level. The compensation gray level calculator may calculate the gamma compensation value based on the first luminance characteristic value, the second luminance characteristic value, and the third luminance characteristic value in a third case where the expected correction gray level is included in the third unit section.

In an embodiment, in the third case, the compensation gray level calculator may calculate the gamma compensation value by a sixth equation of:

$$\gamma t = \frac{\gamma 3 \cdot \ln(gt/g3) + \gamma 2 \cdot \ln(g3/g2) + \gamma 1 \cdot \ln(g2/g1)}{\ln(gt/g1)}$$

wherein γt may represent the gamma compensation value, γ1 may represent the first luminance characteristic value, γ2 may represent the second luminance characteristic value, γ3 may represent the third luminance characteristic value, g1 may represent the first reference gray level, g2 may represent the second reference gray level, g3 may represent the third reference gray level, and gt may represent the expected correction gray level.

In an embodiment, the compensation gray level calculator may further calculate a second compensation gray level that corresponds to the second reference gray level and a third compensation gray level that corresponds to the third reference gray level, and calculate compensation gray levels that corresponds to an entire gray level region by applying a linear interpolation and/or extrapolation method to the first, second, and third compensation gray levels.

A display system according to an embodiment of the present disclosure may include: a luminance compensating apparatus providing a first reference image data, a second reference image data, and a third reference image data corresponding to a first reference gray level, a second reference gray level, and a third reference gray level, respectively; a display panel displaying a first reference gray level image, a second reference gray level image, and a third reference gray level image based on the first, second, and third reference image data; and an imaging unit capturing the first, second, and third reference gray level images, generating a first captured image data, a second captured image data, and a third captured image data, and providing the first, second, and third captured image data to the luminance compensating apparatus. The luminance compensating apparatus may include: a luminance characteristic value calculator calculating a first luminance characteristic value corresponding to a first unit section between the first and second reference gray levels based on the first and second captured image data, and calculating a second luminance characteristic value corresponding to a second unit section between the second and third reference gray levels based on the second and third captured image data; an expected correction gray level calculator calculating an expected correction gray level corresponding to the first reference gray level based on the first captured image data; and a compensation gray level calculator calculating a gamma compensation value and a compensation gray level corresponding to the first reference gray level based on the gamma compensation value and the expected correction gray level. The compensation gray level calculator may calculate the gamma compensation value based on the first luminance characteristic value in a first case where the expected correction gray level is included in the first unit section, and calculate the gamma compensation value based on the first luminance characteristic value and the second luminance characteristic value in a case where the expected correction gray level is included in the second unit section.

In an embodiment, the luminance compensating apparatus may further include a reference image data supplier supplying the first, second, and third reference image data to the display panel.

In an embodiment, the display panel may include a plurality of pixels, and the compensation gray level calculator may calculate the compensation gray level for each of the plurality of pixels.

In an embodiment, the display panel may include a plurality of unit blocks, and each of the plurality of unit blocks may include a plurality of pixels, and the compensation gray level calculator may calculate the compensation gray level for each of the plurality of unit blocks.

A method of compensating luminance according to an embodiment of the present disclosure may include: providing a first reference image data, a second reference image data, and a third reference image data corresponding to a first reference gray level, a second reference gray level, and a third reference gray level to the display panel; generating a first captured image data, a second captured image data, and a third captured image data by capturing a first reference gray level image, a second reference gray level image, and a third reference gray level image displayed on the display panel based on the first, second, and third reference image data; calculating a first luminance characteristic value corresponding to a first unit section between the first and second reference gray levels, and a second luminance characteristic value corresponding to a second unit section between the second and third reference gray levels based on the first, second, and third captured image data; calculating an expected correction gray level corresponding to the first reference gray level based on the first, second, and third captured image data; and calculating a compensation gray level corresponding to the first reference gray level based on a gamma compensation value and the expected correction gray level. The calculating the compensation gray level may include: calculating the gamma compensation value based on the first luminance characteristic value in a first case where the expected correction gray level is included in the first unit section; and calculating the gamma compensation value based on the first luminance characteristic value and the second luminance characteristic value in a second case where the expected correction gray level is included in the second unit section.

In an embodiment, in the second case, the gamma compensation value may be calculated by a seventh equation of:

$$\gamma t = \frac{\gamma 2 \cdot \ln(gt/g2) + \gamma 1 \cdot \ln(g2/g1)}{\ln(gt/g1)}$$

wherein γt may represent the gamma compensation value, γ1 may represent the first luminance characteristic value, γ2 may represent the second luminance characteristic value, g1 may represent the first reference gray level, g2 may represent the second reference gray level, and gt may represent the expected correction gray level.

In an embodiment, the first captured image data may include a first luminance value displayed on the display panel corresponding to the first reference gray level.

In an embodiment, the calculating the expected correction gray level may include: calculating a luminance compensation ratio based on a difference between the first luminance value and a first luminance target value that corresponds to the first reference gray level; and calculating the expected correction gray level based on the luminance compensation ratio.

BRIEF DESCRIPTION OF THE DRAWINGS

The accompanying drawings that are included to provide a further understanding of the inventive concepts and are incorporated in and constitute a part of this specification, illustrate exemplary embodiments of the inventive concepts of the present disclosure, and, together with the description, serve to explain principles of the inventive concepts of the present disclosure.

FIGS. 8A and 8B are examples of tables for calculating a luminance characteristic value of the luminance compensating apparatus of FIG. 1.

DETAILED DESCRIPTION OF THE ILLUSTRATED EMBODIMENTS

Figure 1:
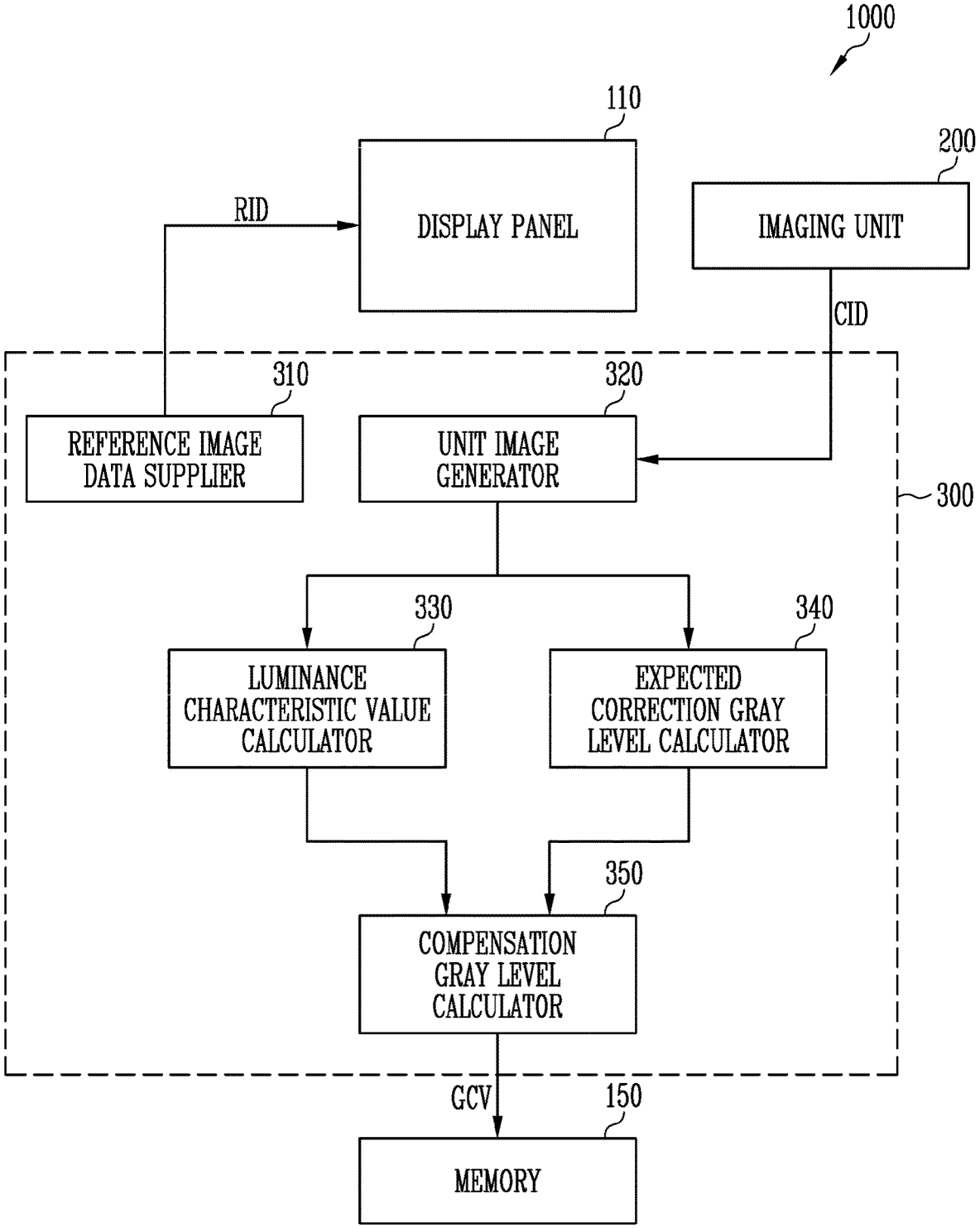
FIG. 1 is a block diagram illustrating a display system including a luminance compensating apparatus according to an embodiment of the present disclosure.

As the present disclosure allows for various changes and numerous embodiments, particular embodiments will be illustrated in the drawings and described in detail in the written description. However, this is not intended to limit the present disclosure to particular modes of practice, and it is to be appreciated that all changes, equivalents, and substitutes that do not depart from the spirit and technical scope of the present disclosure are encompassed in the present disclosure.

In the drawings, similar reference numerals denote similar elements. In the accompanying drawings, the sizes of elements may be shown to be enlarged than the actual size for clarity of the present disclosure. It will be understood that, although the terms "first," "second," etc. may be used herein to describe various elements, these elements should not be limited by these terms. Instead, these terms are used to distinguish one element from another element. For instance, a first element discussed below could be termed a second element without departing from the scope of the present disclosure. Similarly, the second element could also be termed the first element. In the present disclosure, singular forms are intended to include plural forms as well, unless the context clearly indicates otherwise.

It will be further understood that the terms "comprise," "include," "have," etc. used in the present disclosure, specify the presence of stated features, integers, steps, operations, elements, components, and/or any combinations of them but do not preclude the presence or addition of one or more other features, integers, steps, operations, elements, components, and/or combinations thereof.

In addition, an expression that an element is "coupled" to another element includes not only a case where the element is directly coupled to the other element, but also a case where another element is coupled between them.

Hereinafter, embodiments of the present disclosure will be described in detail with reference to the accompanying drawings.

Figure 2:
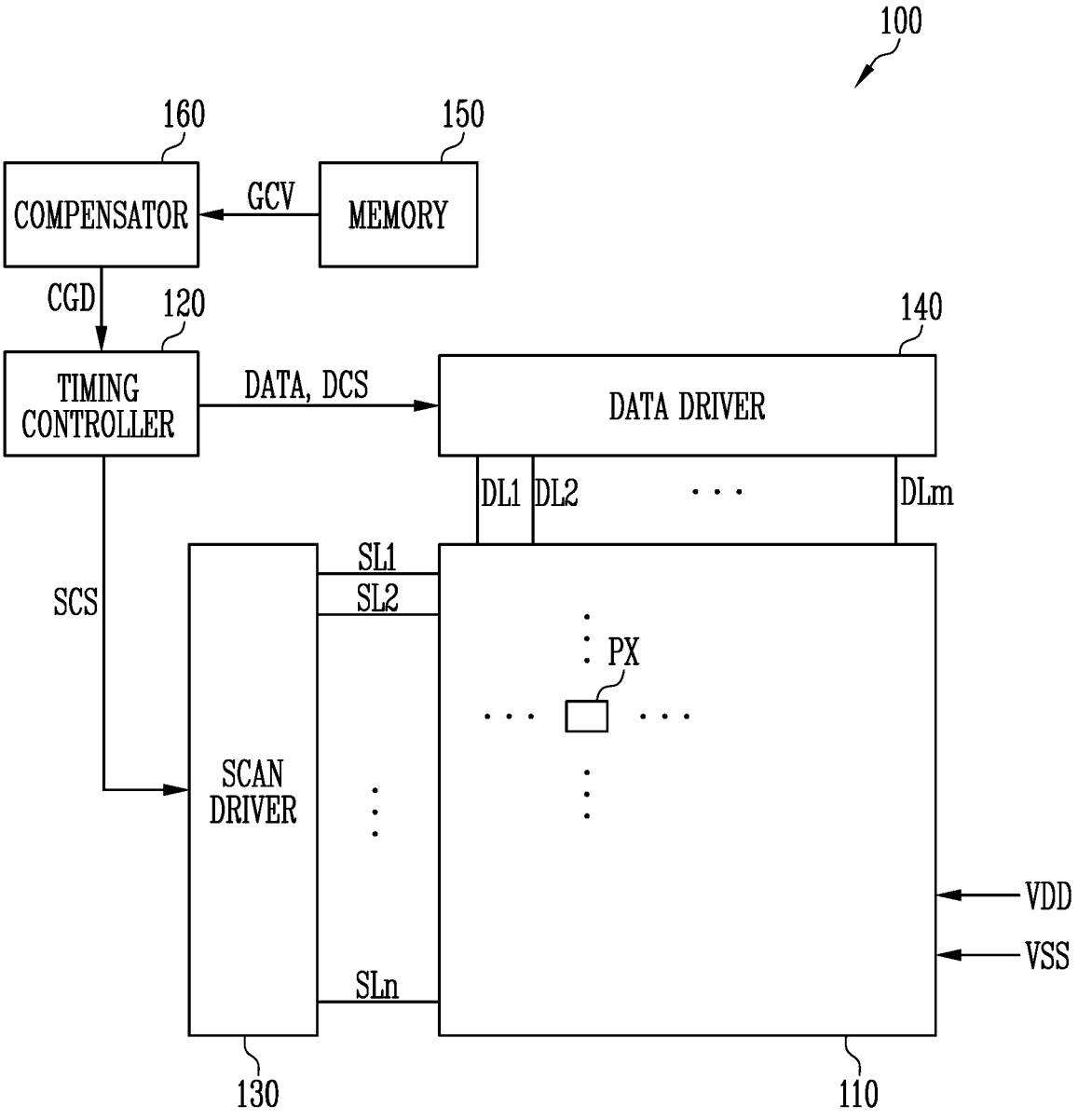
FIG. 2 is a block diagram illustrating an example of a display device including a memory in which compensation gray levels generated by the luminance compensating apparatus of FIG. 1 are stored.
Figure 3:
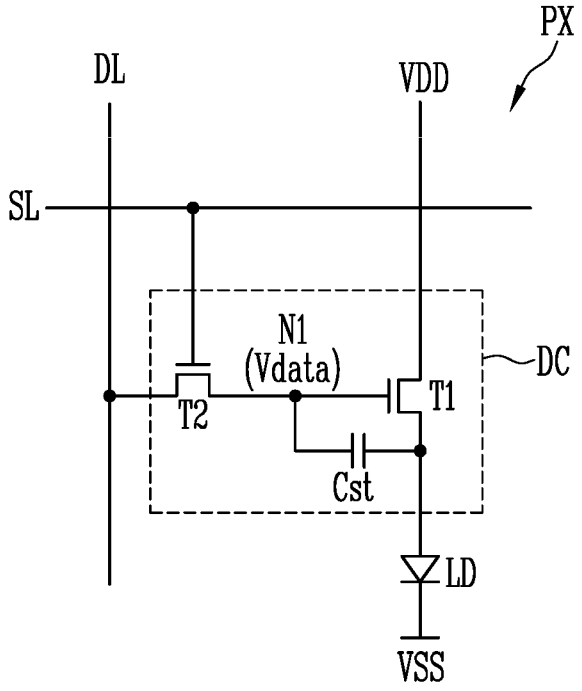
FIG. 3 is a circuit diagram illustrating an example of a pixel included in the display device of FIG. 2.

FIG. 1 is a block diagram illustrating a display system including a luminance compensating apparatus according to an embodiment of the present disclosure. FIG. 2 is a block diagram illustrating an example of a display device 100 including a memory 150 in which compensation gray levels generated by the luminance compensating apparatus of FIG. 1 are stored. FIG. 3 is a circuit diagram illustrating an example of a pixel included in the display device 100 of FIG. 2.

Referring to FIG. 1, a display system 1000 includes a display panel 110, an imaging unit 200, a luminance compensating apparatus 300, and the memory 150. The luminance compensating apparatus 300 may supply reference image data RID to the display panel 110, and the imaging unit 200 may capture an image displayed on the display panel 110 based on the reference image data RID and generate captured image data CID. The luminance compensating apparatus 300 may receive the captured image data CID from the imaging unit 200 and perform luminance compensation for the display panel 110 using the captured image data CID.

Hereinafter, the display device 100 including the display panel 110 will be described, and the luminance compensating apparatus 300 according to the configuration of the display device, and the display system 1000 including the same will be described thereafter. FIGS. 2 and 3 may be referred to describe the display device including the display panel 110.

Referring to FIGS. 1 and 2, the display device 100 may include the display panel 110, a timing controller 120, a scan driver 130, a data driver 140, the memory 150, and a compensator 160.

The display panel 110 may include a plurality of scan lines SL1 to SLn, a plurality of data lines DL1 to DLm, and a plurality of pixels PX.

Each of the pixels PX may be connected to at least one of the scan lines SL1 to SLn and at least one of the data lines DL1 to DLm. Meanwhile, the pixels PXs may receive voltages of a first power source VDD and a second power source VSS from outside. Here, the first power source VDD and the second power source VSS may be voltages required for the operation of the pixels PX. For example, the first power source VDD may have a voltage level higher than a voltage level of the second power source VSS.

Referring to FIG. 3, the pixel PX may include a light emitting element LD and a driving circuit DC connected to the light emitting element LD to drive the light emitting element LD.

A first electrode (e.g., an anode electrode) of the light emitting element LD may be connected to the first power source VDD via the driving circuit DC, and a second electrode (e.g., a cathode electrode) of the light emitting element LD may be connected to the second power source VSS. The light emitting element LD may emit light at a luminance corresponding to an amount of driving current controlled by the driving circuit DC.

The light emitting element LD may include an organic light emitting diode. In addition, the light emitting element LD may include an inorganic light emitting diode such as a micro light emitting diode (LED) or a quantum dot light emitting diode. In addition, the light emitting element LD may be an element including an organic material and an inorganic material. In FIG. 3, the pixel PX includes a single light emitting element LD. However, in another embodiment, the pixel PX may include a plurality of light emitting elements. The plurality of light emitting elements may be connected in series, in parallel, or in series and parallel.

The first power source VDD and the second power source VSS may have different potentials. For example, the voltage applied through the first power source VDD may be greater than the voltage applied through the second power source VSS.

The driving circuit DC may include a first transistor T1, a second transistor T2, and a storage capacitor Cst.

A first electrode of the first transistor T1 (herein also referred to as a driving transistor) may be connected to the first power source VDD, and a second electrode of the first transistor T1 may be electrically connected to the first electrode (or the anode electrode) of the light emitting element LD. A gate electrode of the first transistor T1 may be connected to a first node N1. The first transistor T1 may control an amount of driving current supplied to the light emitting element LD in response to a data voltage Vdata supplied to the first node N1 through a data line DL.

A first electrode of the second transistor T2 (herein also referred to as a switching transistor) may be connected to the data line DL, and a second electrode of the second transistor T2 may be connected to the first node N1. A gate electrode of the second transistor T2 may be connected to a scan line SL.

The second transistor T2 may be turned on when a scan signal of a voltage (e.g., a gate-on voltage) is supplied from the scan line SL to electrically connect the data line DL and the first node N1. At this time, the data voltage Vdata of a corresponding frame is supplied to the data line DL, and accordingly, the data voltage Vdata may be transferred to the first node N1. The data voltage Vdata transferred to the first node N1 may be stored in the storage capacitor Cst.

One electrode of the storage capacitor Cst may be connected to the first node N1, and the other electrode of the storage capacitor Cst may be connected to the first electrode (or the anode electrode) of the light emitting element LD. The storage capacitor Cst may be charged with the data voltage Vdata supplied to the first node N1, and may maintain the charged voltage until the data voltage Vdata of the next frame is supplied.

FIG. 3 shows the pixel PX having a relatively simple structure for convenience of description. The structure of the driving circuit DC may be variously changed without deviating from the scope of the present disclosure. For example, the driving circuit DC may include various transistors such as a compensation transistor for compensating a threshold voltage of the first transistor T1, an initialization transistor for initializing the first node N1, and/or a light emitting control transistor for controlling a light emitting time of the light emitting element LD. In addition, the driving circuit DC may further include more than one storage capacitors and/or other circuit elements such as a boosting capacitor for boosting a voltage of the first node N1.

In FIG. 3, the first and second transistors T1 and T2 are shows as N-type transistors, but the present disclosure is not limited thereto. That is, at least one of the first and second transistors T1 and T2 included in the driving circuit DC may be changed to a P-type transistor.

The pixel PX included in the display panel 110 may control an amount of driving current supplied to the light emitting element LD according to the data voltage Vdata, and the light emitting element LD may emit light according to the amount of driving current to display an image.

In theory, display panels 110 that are manufactured through the same process are expected to have the same luminance characteristic, but, in practice, the display panels 110 may not exhibit the same luminance characteristic due to deviations in a manufacturing process. In addition, the luminance characteristic of the pixel PX may be different when the pixel PX is designed and after the manufacturing process is completed. The deviations in the luminance characteristic may be different for each of the display panels 110 or may be different for each pixel PX included in the same display panel 110.

Due to the deviations in the luminance characteristic, even if the same data voltage Vdata is supplied to the pixels PX, a luminance difference may occur between the pixels PX. For example, such deviations include, not are not limited to, deviations of a threshold voltage and channel mobility of the first transistor T1 (the driving transistor) included in each pixel PX. This may cause an image distortion such as Mura effect on the display panel 110. Therefore, a luminance compensation process may be performed to compensate for such image distortion before the display panel 110 is shipped to a customer.

Referring back to FIG. 2, the timing controller 120 may receive a control signal from the outside (e.g., a graphic processor) and receive compensation image data CGD from the compensator 160. The timing controller 120 may generate a scan control signal SCS and a data control signal DCS based on the control signal, and convert the compensated image data CGD to generate a data signal DATA. Examples of the control signal may include, but are not limited to, a vertical synchronization signal, a horizontal synchronization signal, and a clock signal.

The scan driver 130 may generate scan signals based on the scan control signal SCS provided from the timing controller 120. Examples of the scan control signal SCS may include, but are not limited to, a scan start signal, and a scan clock signal. The scan driver 130 may sequentially provide the scan signals having a turn-on level pulse to the scan lines SL1 to SLn.

The data driver 140 may generate data voltages Vdata based on the data signal DATA and the data control signal DCS received from the timing controller 120, and provide the data voltages Vdata to the data lines DL1 to DLm. The data driver 140 may generate analog-type data voltages Vdata based on digital-type data signal DATA. For example, the data driver 140 may sample gray level values included in the data signal DATA and provide the data voltages Vdata corresponding to the gray level values to the data lines DL1 to DLm in units of pixel rows. Examples of the data control signal DCS include, but are not limited to, a data clock signal and a data enable signal.

The memory 150 may store a compensation gray level GCV, and the compensation gray level GCV may be used to compensate for a distortion of an image displayed on the display panel 110 that may be caused by a deviation in luminance of the pixels PX. The compensation gray level GCV may be generated by the luminance compensating apparatus 300 or the display system 1000 of FIG. 1.

The compensation gray level GCV may be generated for each pixel PX. Alternatively, the compensation gray level GCV may be generated for each block unit including a predetermined number of pixels PX. For convenience of description, hereinafter, it is assumed that the compensation gray level GCV is generated for each pixel PX.

The memory 150 may be implemented as an independent component within the display device 100. However, this is an example, and the present disclosure is not limited thereto. In another embodiment, the memory 150 may be implemented as being embedded in the timing controller 120 or the data driver 140.

The compensator 160 may receive input image data from the outside (e.g., the graphic processor) and receive the compensation gray level GCV stored in the memory 150. The compensator 160 may generate the compensation image data CGD by correcting the input image data based on the compensation gray level GCV and supply the compensation image data CGD to the timing controller 120. Meanwhile, in FIG. 2, the timing controller 120 and the compensator 160 are shown as separate components. However, this is an example for convenience of explanation, and the timing controller 120 and the compensator 160 may be integrally configured. For example, the compensator 160 may be implemented as being embedded in the timing controller 120.

According to the compensation image data CGD generated based on the compensation gray level GCV, luminance of the pixels PX included in the display panel 110 may be corrected, so that a distortion in an image displayed on the display panel 110 can be compensated. The specific configuration of the luminance compensating apparatus 300 generating the compensation gray level GCV and the display system 1000 including the same will be described below.

The display panel 110 may receive the reference image data RID from the luminance compensating apparatus 300. Based on the reference image data RID, the data voltage Vdata may be applied to the pixels PX included in the display panel 110 to display an image. At this time, as described with reference to FIGS. 2 and 3, a deviation in luminance characteristic may occur for each pixel PX due to a deviation in a manufacturing process.

The imaging unit 200 may capture the image displayed on the display panel 110 and generate the captured image data CID. For example, the imaging unit 200 may be a two-dimensional charge coupled device (CCD) camera, such as a region scan camera and a frame camera. Here, the captured image data CID may include luminance information of the image displayed on the display panel 110. The imaging unit 200 may supply the captured image data CID to the luminance compensating apparatus 300.

The luminance compensating apparatus 300 may supply the reference image data RID to the display panel 110, receive the captured image data CID corresponding to the image displayed on the display panel 110, and generate the compensation gray level GCV based on the captured image data CID.

In an embodiment, the luminance compensating apparatus 300 may include a reference image data supplier 310, a unit image generator 320, a luminance characteristic value calculator 330, an expected correction gray level calculator 340, and a compensation gray level calculator 350.

The reference image data supplier 310 may sequentially supply K reference image data RID (or first to K-th reference image data RID) corresponding to K reference gray levels (where K is a natural number of 2 or greater) to the display panel 110. Accordingly, the display panel 110 may sequentially display K reference gray level images (or first to K-th reference gray level images) based on the K reference image data RID. The imaging unit 200 may generate K captured image data CID (or first to K-th captured image data CID) by capturing the K reference gray level images sequentially displayed on the display panel 110. Here, the K captured image data CID may include luminance information of the K reference gray level images, respectively. The luminance information may include luminance values measured for each pixel PX included in the display panel 110.

According to an embodiment, the K reference gray levels may include 6 reference gray levels sampled for 0 to 255 gray levels. In this case, the 6 reference gray levels may include 32 gray levels, 64 gray levels, 96 gray levels, 128 gray levels, 196 gray levels, and 224 gray levels. However, this is an example, and the reference gray levels are not limited thereto. The K reference gray levels may be set in various ways. For example, the K reference gray levels may include 10 reference gray levels sampled for 0 to 255 gray levels.

The unit image generator 320 may generate K unit images based on the K captured image data CID. Here, each of the K unit images may include information on the luminance values measured for each pixel PX for a corresponding reference gray level image.

Meanwhile, as described with reference to FIG. 2, when the compensation gray level GCV is generated for each block unit including a predetermined number of pixels PX, the unit image generator 320 may generate the unit images including information on the luminance values measured for each block for the corresponding reference gray level image. The luminance values measured for each block may be determined by an average luminance value of the pixels PX included in each block. However, this is an example, and the luminance values measured for each block may be determined by a maximum luminance value or a minimum luminance value among the pixels PX included in each block, or a luminance value of a specific pixel PX among the pixels PX included in the corresponding block.

The luminance characteristic value calculator 330 may calculate a luminance characteristic value based on the luminance values measured corresponding to each of the K reference gray levels for each pixel PX included in each of the K unit images. In an embodiment, the luminance characteristic value calculator 330 may calculate K−1 luminance characteristic values in correspondence with the K reference gray levels. For example, the K reference gray levels may calculate the K−1 luminance characteristic values corresponding to a section (hereinafter, referred to as a "unit section") between two adjacent reference gray levels. For example, a section between a first reference gray level and a second reference gray level that is greater than the first reference gray level among the K reference gray levels may be defined as a first unit section, and a section between the second reference gray level and a third reference gray level that is greater than the second reference gray level among the K reference gray levels may be defined as a second unit section. Similarly, a section between the third reference gray level and a fourth reference gray level that is greater than the third reference gray level among the K reference gray levels may be defined as a third unit section.

In an embodiment, the luminance characteristic value calculator 330 may calculate the luminance characteristic values corresponding to each of K−1 unit sections. For example, the luminance characteristic value calculator 330 may calculate the luminance characteristic value corresponding to the first unit section by using a first unit image (an image displayed by the first reference gray level) and a second unit image (an image displayed by the second reference gray level) among the K unit images for each pixel PX. Similarly, the luminance characteristic value calculator 330 may calculate the luminance characteristic value corresponding to the second unit section among the K−1 unit sections by using the second unit image and a third unit image (an image displayed by the third reference gray level) among the K unit images for each pixel PX.

The configuration of the luminance characteristic value calculator 330 for calculating the luminance characteristic value and the unit section will be described in detail with reference to FIGS. 4 to 7.

The expected correction gray level calculator 340 may receive the K unit images from the unit image generator 320. The expected correction gray level calculator 340 may determine the luminance values of the pixels PX corresponding to the reference gray level based on the K unit images.

Meanwhile, a luminance target value corresponding to each of the K reference gray levels for each pixel PX may be previously stored in the expected correction gray level calculator 340. Here, the luminance target value may correspond to the luminance characteristic designed in the display panel 110 in correspondence with a corresponding reference gray level, that is, the luminance value of light emitted by the pixel PX in correspondence with the corresponding reference gray level according to the designed specification of the display panel 110.

An expected correction gray level corresponding to each of the K reference gray levels may be calculated for each pixel PX. The expected correction gray level calculator 340 may calculate the expected corrected gray level corresponding to the corresponding reference gray level, based on a difference between the luminance value measured corresponding to one reference gray level and the luminance target value of the corresponding reference gray level.

In an embodiment, the expected correction gray level calculator 340 may calculate a luminance compensation ratio according to a difference between the luminance value measured corresponding to each of the K reference gray levels and the luminance target value for each pixel PX, and calculate the expected correction gray levels through inverse gamma correction using the luminance compensation ratio and a representative gamma value. Here, the representative gamma value may be a preset luminance characteristic value. For example, the representative gamma value may be 2.2, which is a standard gamma value of the National Television System Committee (NTSC). The luminance compensating apparatus 300 may determine the luminance characteristic values that are reflected in calculating a gamma compensation value based on the unit section in which the expected correction gray level corresponding to each of the K reference gray levels is included. The configuration of the expected correction gray level calculator 340 for calculating the expected correction gray level will be described in detail with reference to FIGS. 4 to 7.

The compensation gray level calculator 350 may calculate the compensation gray level GCV for each pixel PX based on the luminance characteristic value calculated by the luminance characteristic value calculator 330 and the expected correction gray level calculated by the expected correction gray level calculator 340. For example, the compensation gray level calculator 350 may calculate the gamma compensation value corresponding to each of the K reference gray levels based on the luminance characteristic value and the expected correction gray level, and calculate the compensation gray level GCV corresponding to each of the K reference gray levels based on the gamma compensation value.

In an embodiment, the compensation gray level calculator 350 may calculate the gamma compensation value based on the unit section in which the expected correction gray level is included among the unit sections. That is, in a case where the expected correction gray level is out of the unit section in which the reference gray level is included, the compensation gray level calculator 350 may calculate the gamma compensation value by reflecting all luminance characteristic values corresponding to the unit sections between the reference gray level and the expected correction gray level. For example, if the expected correction gray level corresponding to the first reference gray level included in the first unit section among the K reference gray levels is included in the first unit section, the compensation gray level calculator 350 may calculate a first luminance characteristic value corresponding to the first unit section as the gamma compensation value. In another example, if the expected correction gray level corresponding to the first reference gray level included in the first unit section among the K reference gray levels is included in the second unit section, the compensation gray level calculator 350 may calculate the gamma compensation value based on the first luminance characteristic value corresponding to the first unit section and a second luminance characteristic value corresponding to the second unit section. In yet another example, if the expected correction gray level corresponding to the first reference gray level included in the first unit section among the K reference gray levels is included in the third unit section, the compensation gray level calculator 350 may calculate the gamma compensation value based on the first luminance characteristic value corresponding to the first unit section, the second luminance characteristic value corresponding to the second unit section, and a third luminance characteristic value corresponding to the third unit section.

In an embodiment, the compensation gray level calculator 350 may calculate the gamma compensation value according to a sign of the luminance compensation ratio. The luminance compensation ratio having a positive value may indicate that the luminance value measured corresponding to the reference gray level is smaller than the luminance target value corresponding to the corresponding reference gray level. On the other hand, the luminance compensation ratio having a negative value may indicate that the luminance value measured corresponding to the reference gray level is greater than the luminance target value corresponding to the corresponding reference gray level. If the luminance compensation ratio calculated by the expected correction gray level calculator 340 has a negative value, for example, when the expected correction gray level corresponding to the first reference gray level is included in a fourth unit section, the compensation gray level calculator 350 may calculate the gamma compensation value based on a fourth luminance characteristic value corresponding to the fourth unit section.

In an embodiment, the compensation gray level calculator 350 may calculate the compensation gray level GCV through inverse gamma correction using the luminance compensation ratio calculated by the expected correction gray level calculator 340 and the gamma compensation value for each of the K reference gray levels.

In another embodiment, the compensation gray level calculator 350 may calculate the compensation gray level GCV corresponding to an entire gray level region by applying a linear interpolation and/or extrapolation method to the compensation gray levels GCV corresponding to the K reference gray levels.

The configuration of the compensation gray level calculator 350 for calculating the gamma compensation value and the configuration for calculating the compensation gray level GCV will be described in detail with reference to FIGS. 4 to 7.

The memory 150 may receive and store the compensation gray level GCV calculated by the compensation gray level calculator 350. The memory 150 may store the compensation gray levels GCV corresponding to the entire gray level region for each pixel PX. Here, the memory 150 may be configured as described with reference to FIGS. 1 and 2.

FIGS. 4 to 7 are diagrams for explaining examples of an operation of the luminance compensating apparatus 300 of FIG. 1. In FIGS. 4 to 7, a case in which the K reference gray levels include 6 reference gray levels (e.g., 32 gray levels, 64 gray levels, 96 gray levels, 128 gray levels, 196 gray levels, and 224 gray levels) sampled for 0 to 255 gray levels will be described as an example. Among the 6 reference gray levels, 96 gray levels may be defined as a first reference gray level g1, 128 gray levels may be defined as a second reference gray level g2, 196 gray levels may be defined as a third reference gray level g3, 224 gray levels may be defined as a fourth reference gray level g4, and 64 gray levels may be defined as a fifth reference gray level g5. In addition, a first unit section SU1 may be defined to correspond to a section from 96 to 127 gray levels (that is, the first reference gray level g1 to the second reference gray level g2), a second unit section SU2 may be defined to correspond to a section from 128 to 195 gray levels (that is, the second reference gray level g2 to the third reference gray level g3), a third unit section SU3 may be defined to correspond to a section from 196 to 223 gray levels (that is, the third reference gray level g3 to the fourth reference gray level g4), and a fourth unit section SU4 may be defined to correspond to a section from 64 to 95 gray levels (that is, the fourth reference gray level g4 to the first reference gray level g1). Meanwhile, for convenience of description, in FIGS. 4 to 7, the operation of the luminance compensating apparatus 300 is implemented for one pixel PX (e.g., the pixel PX of FIG. 2) as an example. The configuration for calculating the compensation gray level GCV for the first reference gray level g1 will be mainly described.

Referring to FIGS. 1 and 4 to 7, the luminance characteristic value calculator 330 may calculate the luminance characteristic values, for example, first to fourth luminance characteristic values γ1 to γ4, corresponding to each of the unit sections, for example, the first to fourth unit sections SU1 to SU4.

Corresponding to the first unit section SU1, the luminance characteristic value calculator 330 may calculate the first luminance characteristic value γ1 corresponding to the first unit section SU1 using the first luminance value measured in response to the first reference gray level g1 and the second luminance value measured in response to the second reference gray level g2.

Similarly, corresponding to the second unit section SU2, the luminance characteristic value calculator 330 may calculate the second luminance characteristic value γ2 corresponding the second unit section SU2 using the second luminance value measured in response to the second reference gray level g2 and the third luminance value measured in response to the third reference gray level g3.

Similarly, corresponding to the third unit section SU3, the luminance characteristic value calculator 330 may calculate the third luminance characteristic value γ3 corresponding to the third unit section SU3 using the third luminance value measured in response to the third reference gray level g3 and the fourth luminance value measured in response to the fourth reference gray level g4.

Similarly, corresponding to the fourth unit section SU4, the luminance characteristic value calculator 330 may calculate a fourth luminance characteristic value γ4 corresponding to the fourth unit section SU4 using the fifth luminance value measured in response to the fifth reference gray level g5 and the first luminance value measured in response to the first reference gray level g1.

In an embodiment, the first to fourth luminance characteristic values γ1 to γ4 may be calculated by Equation 1 below according to a gamma correction formula.

$$\gamma 1 = \frac{\ln(L1/L2)}{\ln(g1/g2)},\ \gamma 2 = \frac{\ln(L2/L3)}{\ln(g2/g3)},\quad \gamma 3 = \frac{\ln(L3/L4)}{\ln(g3/g4)},\ \gamma 4 = \frac{\ln(L5/L1)}{\ln(g5/g1)} \qquad \text{[Equation 1]}$$

Here, γ1 to γ4 represent the first to fourth luminance characteristic values, L1 to L5 represent measured first to fifth luminance values, and g1 to g5 represent the first to fifth reference gray levels.

An exemplary case in which the expected correction gray level (or a first expected correction gray level gt1) that corresponds to the first reference gray level g1 included in the first unit section SU1 among the K reference gray levels (that is, the 6 reference gray levels) is included in the first unit section SU1 will be explained with reference to FIGS. 1 and 4.

Figure 4:
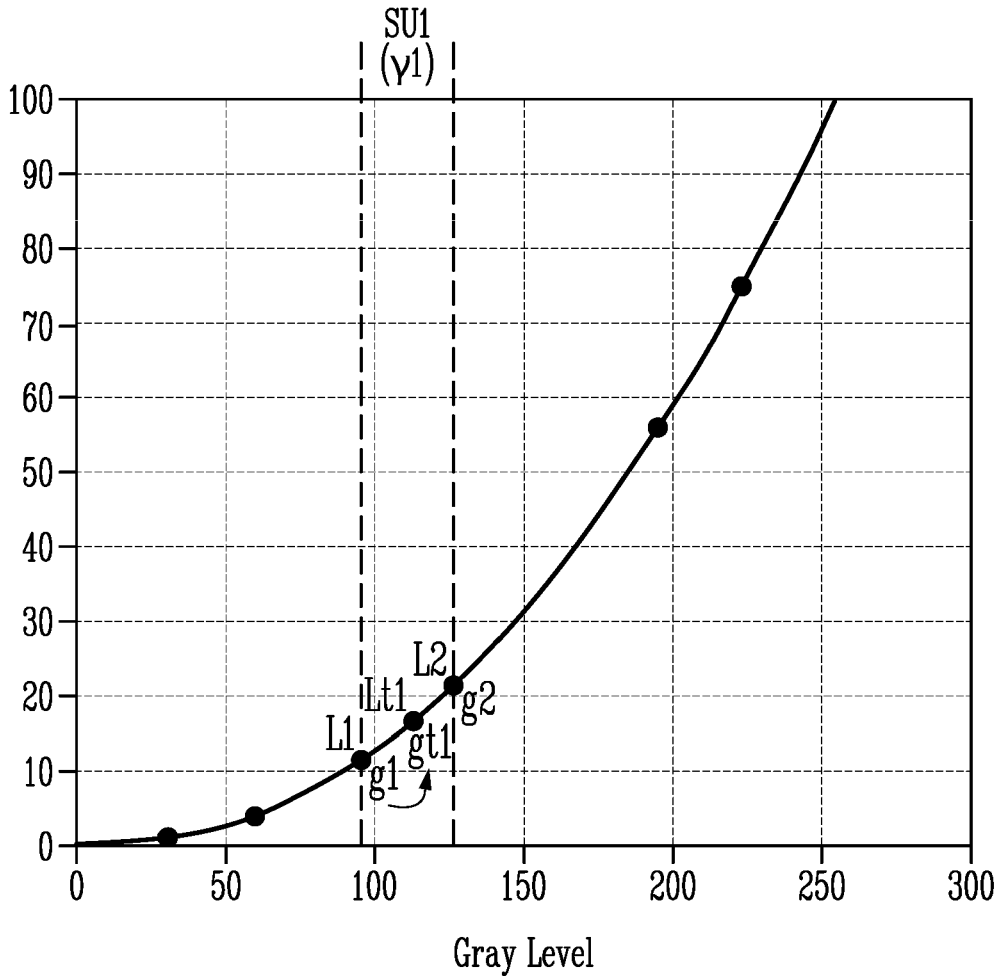
FIGS. 4, 5, 6, and 7 are diagrams for explaining examples of an operation of the luminance compensating apparatus of FIG. 1.

Referring to FIGS. 1 and 4, the expected correction gray level calculator 340 may calculate the luminance compensation ratio according to a difference between a first luminance value L1 measured in response to the first reference gray level g1 and the luminance target value of the first reference gray level g1. In this case, the luminance compensation ratio may be calculated by Equation 2 below.

$$LCR = \frac{LT - L1}{L1} \qquad \text{[Equation 2]}$$

Here, LCR represents the luminance compensation ratio, LT represents the luminance target value, and L1 represents the first luminance value L1. Meanwhile, in FIG. 4, it is assumed that the luminance target value LT is a first luminance target value Lt1.

After obtaining the luminance compensation ratio LCR from Equation 2, the expected correction gray level calculator 340 of the luminance compensating apparatus 300 may calculate the expected correction gray level (or the first expected correction gray level gt1) using Equation 3 below to determine the luminance characteristic value to be reflected in calculating the gamma compensation value corresponding to the first reference gray level g1. That is, the luminance compensating apparatus 300 may determine the luminance characteristic value to be reflected in calculating the gamma compensation value by predicting the unit section in which a correction gray level corresponding to the first reference gray level g1 is included, through the unit section in which the expected correction gray level is included. To this end, based on the calculated luminance compensation ratio and the representative gamma value, the expected correction gray level calculator 340 may calculate the first expected correction gray level gt1 through the inverse gamma correction for the luminance compensation ratio using the representative gamma value. Here, the representative gamma value may be 2.2, which is the standard gamma value of the NTSC.

Accordingly, the first expected correction gray level gt1 may be calculated by Equation 3 below.

$$gt1 = g1 \times (1+\mathrm{LCR})^{1/22} \quad \text{[Equation 3]}$$

Here, gt1 represents the first expected correction gray level, g1 represents the first reference gray level, and LCR represents the luminance compensation ratio.

The compensation gray level calculator 350 may calculate the gamma compensation value based on the unit section in which the first expected correction gray level gt1 calculated by the expected correction gray level calculator 340 is included. In the present example, the first expected correction gray level gt1 is included in the first unit section SU1, therefore the compensation gray level calculator 350 may calculate the first luminance characteristic value γ1 that corresponds to the first unit section SU1 as the gamma compensation value.

Accordingly, based on the gamma compensation value and the luminance compensation ratio as shown in Equation 4 below, the compensation gray level calculator 350 may calculate the compensation gray level GCV through the inverse gamma correction for the luminance compensation ratio using the gamma compensation value.

$$gcv = g1 \times (LCR)^{\frac{1}{\gamma t}} \quad \text{[Equation 4]}$$

Here, gcv represents the compensation gray level GCV, g1 represents the first reference gray level, LCR represents the luminance compensation ratio, and γt represents the gamma compensation value. In the present example of FIG. 4, the gamma compensation value γt may be the same as the first luminance characteristic value γ1 as described above.

As described with reference to FIGS. 1 and 4, in a case where the first expected correction gray level gt1 corresponding to the first reference gray level g1 included in the first unit section SU1 among the K reference gray levels is included in the first unit section SU1, the luminance compensating apparatus 300 may calculate the gamma compensation value γt using the first luminance characteristic value γ1 corresponding to the first unit section SU1. Since the first expected correction gray level gt1 is included in the first unit section SU1 corresponding to the first reference gray level g1, the luminance compensating apparatus 300 calculates the gamma compensation value γt using only the first luminance characteristic value γ1, and the luminance compensating apparatus 300 may relatively accurately calculate the compensation gray level GCV. In addition, the configuration for calculating the compensation gray level GCV of the luminance compensating apparatus 300 can be simplified due to the simple calculation.

Meanwhile, as described with reference to FIG. 1, the compensation gray level calculator 350 may calculate the compensation gray level GCV to the entire gray level region by applying a linear interpolation and/or extrapolation method to the compensation gray levels GCV corresponding to the K reference gray levels.

For example, the luminance compensating apparatus 300 may calculate the compensation gray level GCV of 0 to 31 gray levels by applying the linear interpolation and/or extrapolation method to the compensation gray level GCV of 32 gray levels.

In addition, the luminance compensating apparatus 300 may calculate the compensation gray level GCV of 33 to 63 gray levels by applying the linear interpolation and/or extrapolation method to the compensation gray level GCV of 32 gray levels and the compensation gray level GCV of 64 gray levels.

In addition, the luminance compensating apparatus 300 may calculate the compensation gray level GCV of 65 to 95 gray levels by applying the linear interpolation and/or extrapolation method to the compensation gray level GCV of 64 gray levels and the compensation gray level GCV of 96 gray levels.

In addition, the luminance compensating apparatus 300 may calculate the compensation gray level GCV of 97 to 127 gray levels by applying the linear interpolation and/or extrapolation method to the compensation gray level GCV of 96 gray levels and the compensation gray level GCV of 128 gray levels.

In addition, the luminance compensating apparatus 300 may calculate the compensation gray level GCV of 129 to 195 gray levels by applying the linear interpolation and/or extrapolation method to the compensation gray level GCV of 128 gray levels and the compensation gray level GCV of 196 gray levels.

In addition, the luminance compensating apparatus 300 may calculate the compensation gray level GCV of 197 to 223 gray levels by applying the linear interpolation and/or extrapolation method to the compensation gray level GCV of 196 gray levels and the compensation gray level GCV of 224 gray levels.

In addition, the luminance compensating apparatus 300 may calculate the compensation gray level GCV of 225 to 255 gray levels by applying the linear interpolation method to the compensation gray level GCV of 224 gray levels.

In this way, the luminance compensating apparatus 300 may calculate the compensation gray level GCV to the entire gray level region by using partial gray levels (e.g., the 6 reference gray levels).

Next, another exemplary case in which the expected correction gray level (or a second expected correction gray level gt2) that corresponds to the first reference gray level g1 included in the first unit section SU1 among the K reference gray levels (that is, 6 reference gray levels) is included in the second unit section SU2 will be explained with reference to FIGS. 1 and 5. Meanwhile, in FIG. 5, it is assumed that the luminance target value LT is a second luminance target value Lt2.

Figure 5:
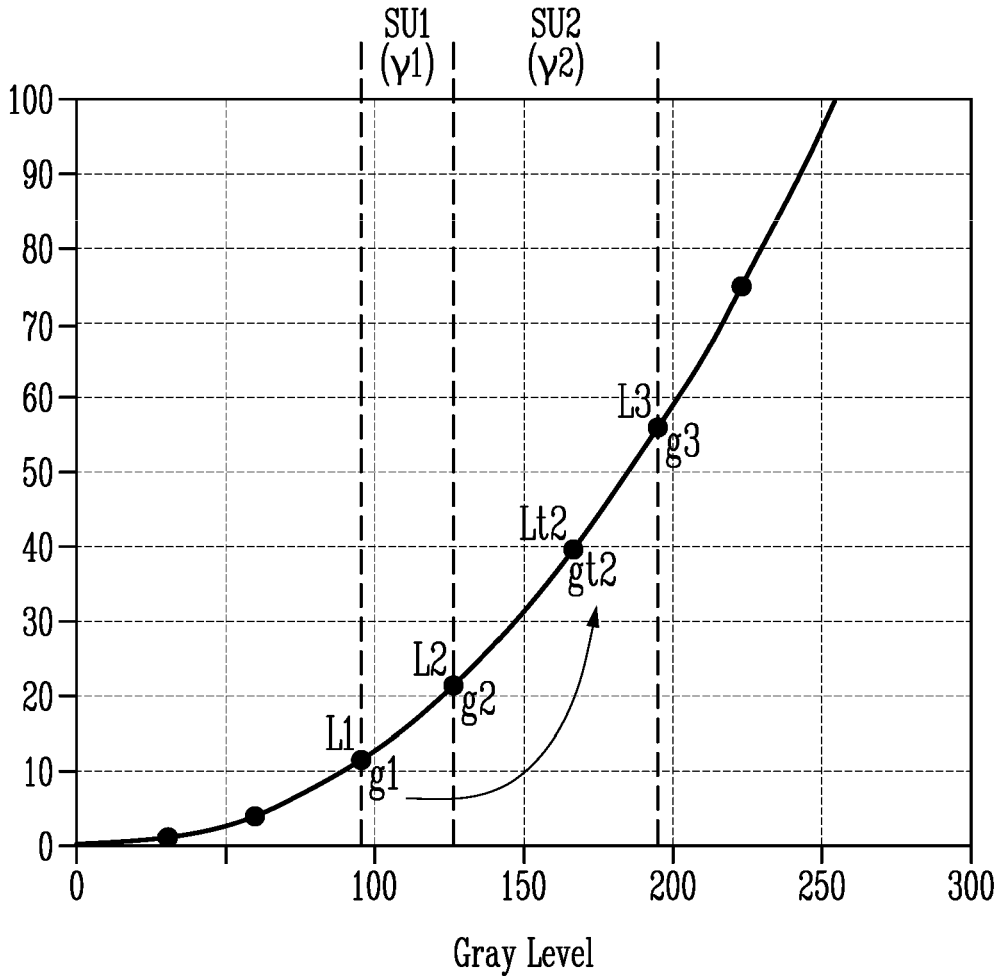

Referring to FIGS. 1 and 5, the expected correction gray level calculator 340 may calculate the second expected correction gray level gt2 through the inverse gamma correction based on the calculated luminance compensation ratio and the representative gamma value. Here, the second expected correction gray level gt2 may be calculated by Equation 5 below, which is substantially similar to Equation 3 that is described with reference to FIG. 4.

$$gt2=g2\times(1+\mathrm{LCR})^{1/22} \quad \text{[Equation 5]}$$

Here, gt2 represents the second expected correction gray level, g2 represents the second reference gray level, and LCR represents the luminance compensation ratio.

The compensation gray level calculator 350 may calculate the gamma compensation value based on the unit section in which the second expected correction gray level gt2 calculated by the expected correction gray level calculator 340 is included. In the present example, the second expected correction gray level gt2 is included in the second unit section SU2, therefore the compensation gray level calculator 350 may calculate the gamma compensation value based on the first luminance characteristic value γ1 that corresponds to the first unit section SU1 and the second luminance characteristic value γ2 that corresponds to the second unit section SU2. That is, in a case where the expected correction gray level (or the second expected correction gray level gt2) is out of the unit section (or the first unit section SU1) in which the reference gray level (or the first reference gray level g1) is included, the compensation gray level calculator 350 may calculate the gamma compensation value using all the luminance characteristic values (that is, the first and second luminance characteristic values γ1 and γ2) that correspond to the unit sections (that is, the first and second unit sections SU1 and SU2) between the reference gray level (or the first reference gray level g1) and the expected correction gray level (or the second expected correction gray level gt2).

Specifically, in order to calculate the gamma compensation value in which the luminance characteristic of each unit section is reflected, Equation 6 and Equation 7 below may be used. Equation 6 for calculating the second luminance value L2 may reflect the first luminance characteristic value γ1 that corresponds to the first unit section SU1 between the first reference gray level g1 and the second reference gray level g2, and Equation 7 for calculating the second luminance target value Lt2 may reflect the second luminance characteristic value γ2 that corresponds to the second unit section SU2 between the second reference gray level g2 and the second expected correction gray level gt2. In addition, Equation 9 below may be obtained by combining Equation 8 below for calculating the gamma compensation value γt with Equation 7 according to a gamma correction formula. Accordingly, the compensation gray level calculator 350 may calculate the gamma compensation value based on Equation 9 in which all the luminance characteristic values corresponding to the sections between the first reference gray level g1 and the second expected correction gray level gt2 are reflected.

$$L2 = L1\times\left(\frac{g2}{g1}\right)^{\gamma 1} \quad \text{[Equation 6]}$$

Here, γ1 represents the first luminance characteristic value, L1 and L2 represent the first and second luminance values, and g1 and g2 represent the first and second reference gray levels.

$$Lt2 = L2\times\left(\frac{gt2}{g2}\right)^{\gamma 2} = L1\times\left(\frac{g2}{g1}\right)^{\gamma 1}\times\left(\frac{gt2}{g2}\right)^{\gamma 2} \quad \text{[Equation 7]}$$

Here, Lt2 represents the second luminance target value, γ1 and γ2 represent the first and second luminance characteristic values, L1 and L2 represent the first and second luminance values, g1 and g2 represent the first and second reference gray levels, and gt2 represents the second expected correction gray level.

$$Lt2 = L1\times\left(\frac{gt2}{g1}\right)^{\gamma t} \quad \text{[Equation 8]}$$

Here, Lt2 represents the second luminance target value, γt represents the gamma compensation value, L1 represents the first luminance value, g1 represents the first reference gray level, and gt2 represents the second expected correction gray level.

$$\gamma t = \frac{\gamma 2\cdot\ln(gt2/g2)+\gamma 1\cdot\ln(g2/g1)}{\ln(gt2/g1)} \quad \text{[Equation 9]}$$

Here, γt represents the gamma compensation value, γ1 and γ2 represent the first and second luminance characteristic values, g1 and g2 represent the first and second reference gray levels, and gt2 represents the second expected correction gray level.

As described with reference to FIGS. 1 and 4, in a case where the expected correction gray level is included the unit section in which the reference gray level is included, the compensation gray level calculator 350 may calculate the compensation gray level GCV through the inverse gamma correction using the gamma compensation value and the luminance compensation ratio.

As described with reference to FIGS. 1 and 5, in a case where the expected correction gray level is out of the unit section in which the reference gray level is included, the luminance compensating apparatus 300 may calculate the gamma compensation value by reflecting all the luminance characteristic values corresponding to the unit sections between the reference gray level and the expected correction gray level. Accordingly, the luminance compensating apparatus 300 may accurately calculate the gamma compensation value for calculating the compensation gray level GCV. Therefore, the display quality of the display panel 110 can be improved by effectively and accurately compensating for luminance of the display unevenness.

Although FIG. 5 shows an example case in which the expected correction gray level is out of the unit section in which the reference gray level is included, the second expected correction gray level gt2 corresponding to the first reference gray level g1 is included in the second unit section SU2, and the luminance compensating apparatus 300 calculates the gamma compensation value based on the two luminance characteristic values (i.e., the first and second luminance characteristic values γ1 and γ2) that correspond to the two unit sections (i.e., the first and second unit sections SU1 and SU2), the present disclosure is not limited thereto. In another embodiment, based on the unit section in which the expected correction gray level is included, the luminance compensating apparatus 300 may calculate the gamma compensation value by reflecting three or more luminance characteristic values.

Figure 6:
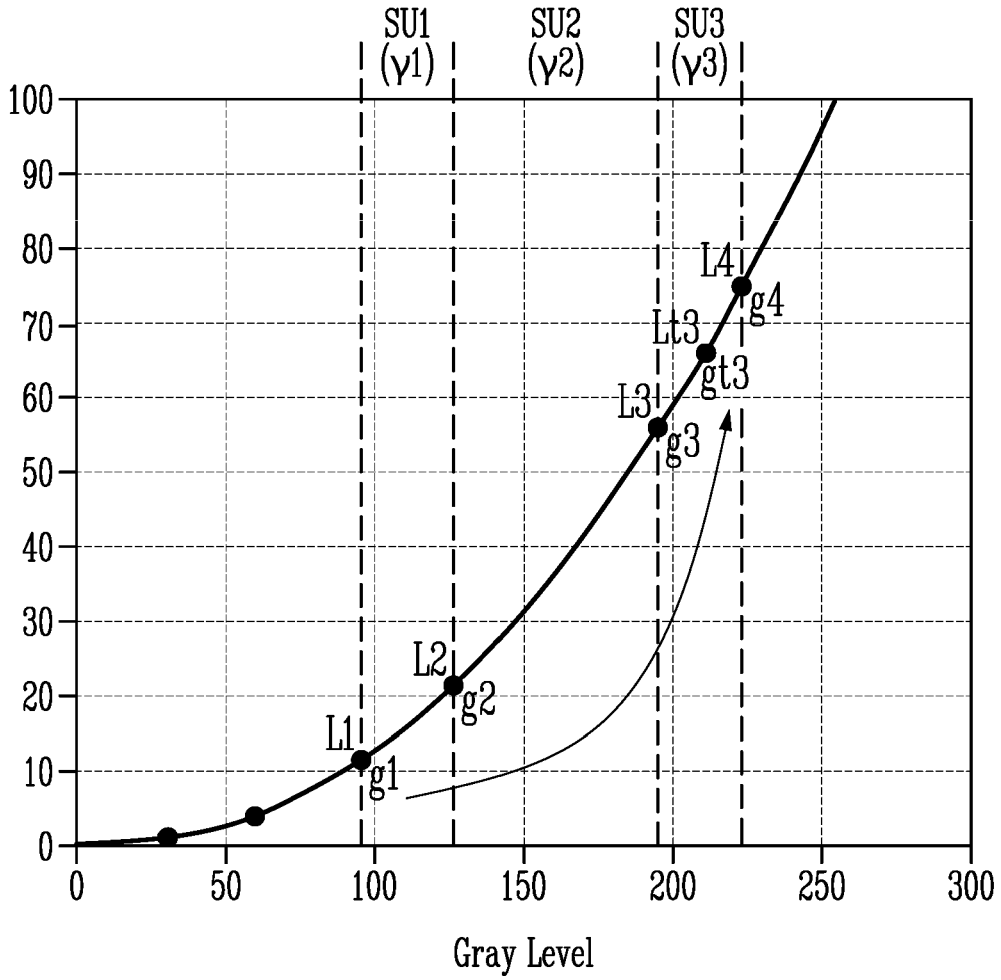

Referring to FIGS. 1 and 6, the expected correction gray level (or a third expected correction gray level gt3) that corresponds to the first reference gray level g1 included in the first unit section SU1 is included in the third unit section SU3. Accordingly, the expected correction gray level calculator 340 may calculate the luminance compensation ratio according to a difference between the first luminance value L1 measured in response to the first reference gray level g1 and the luminance target value LT (or a third luminance target value Lt3), and calculate the third expected correction gray level gt3 using the luminance compensation ratio and the representative gamma value.

In addition, since the third expected correction gray level gt3 is included in the third unit section SU3, the compensation gray level calculator 350 may calculate the gamma compensation value based on the first to third luminance characteristic values γ1, γ2, and γ3. That is, in order to calculate the gamma compensation value in which the luminance characteristic of each unit section is reflected, the compensation gray level calculator 350 may calculate the gamma compensation value based on Equation 10 below that reflects all the luminance characteristic values (that is, the first to third luminance characteristic values γ1, γ2, and γ3) that correspond to the sections between the first reference gray level g1 and the third expected correction gray level gt3.

$$\gamma t = \frac{\gamma 3 \cdot \ln(gt3/g3) + \gamma 2 \cdot \ln(g3/g2) + \gamma 1 \cdot \ln(g2/g1)}{\ln(gt3/g1)} \quad \text{[Equation 10]}$$

Here, γt represents the gamma compensation value, γ1, γ2, and γ3 represent the first to third luminance characteristic values, g1, g2, and g3 represent the first to third reference gray levels, and gt3 represents the third expected correction gray level.

As described above with reference FIGS. 1 to 6, based on the unit section in which the expected correction gray level is included, the luminance compensating apparatus 300 may accurately calculate the gamma compensation value for calculating the compensation gray level GCV by reflecting three or more luminance characteristic values. Therefore, the display quality of the display panel 110 can be improved by effectively and accurately compensating for luminance of the display unevenness.

In addition, the luminance compensating apparatus 300 may calculate the gamma compensation value according to a sign of the luminance compensation ratio. For example, referring to FIGS. 1 and 7, the expected correction gray level calculator 340 may calculate the luminance compensation ratio according to a difference between the first luminance value L1 measured in response to the first reference gray level g1 and the luminance target value LT. In this case, the luminance compensation ratio may be calculated by Equation 2 as described with reference to FIG. 4. Meanwhile, in FIG. 7, it is assumed that the luminance target value LT in Equation 2 is a fourth luminance target value Lt4.

In the present example, since the fourth luminance target value Lt4 is smaller than the first luminance value L1, the luminance compensation ratio may have a negative value. Accordingly, a fourth expected correction gray level gt4 calculated by the expected correction gray level calculator 340 may be smaller than the first reference gray level g1. For example, the fourth expected correction gray level gt4 may be included in the fourth unit section SU4.

Based on the luminance compensation ratio having the negative value, the compensation gray level calculator 350 may calculate the gamma compensation value based on the fourth luminance characteristic value γ4 that corresponds to the fourth unit section SU4 rather than the first luminance characteristic value γ1 that corresponds to the first unit section SU1 in which the first reference gray level is included. In this case, only one unit section, that is, the fourth unit section SU4 may be included between the fourth expected correction gray level gt4 and the first reference gray level g1. Therefore, similar to that described with reference to FIG. 4, the compensation gray level calculator 350 may calculate the fourth luminance characteristic value γ4 as the gamma compensation value, and calculate the compensation gray level GCV by using Equation 4 as described with reference to FIG. 4.

Accordingly, in a case where the luminance value measured in response to the reference gray level is greater than the luminance target value LT, that is, the luminance compensation ratio has a negative value, the luminance compensating apparatus 300 may calculate the compensation gray level GCV more accurately by varying the luminance characteristic value reflected in calculating the gamma compensation value. Therefore, the display quality of the display panel 110 can be further improved.

Figure 7:
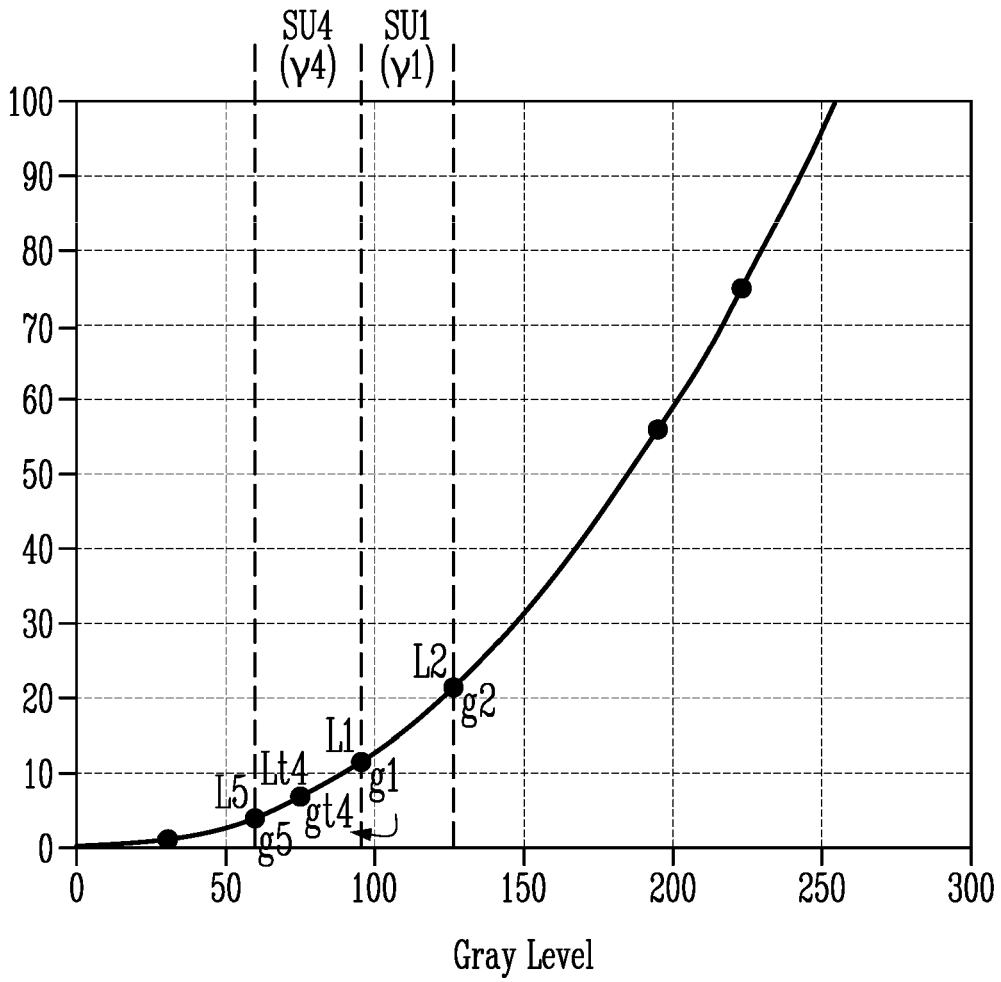

FIG. 7 shows an example case in which the luminance compensation ratio has a negative value, and there is one unit section between the expected correction gray level (i.e., the fourth expected correction gray level gt4) and the reference gray level (i.e., the first reference gray level g1). However, this is only an example, and the present disclosure is not limited thereto. For example, in a case there are two or more unit sections between the expected correction gray level and the reference gray level, as described with reference to FIGS. 5 and 6, the luminance compensating apparatus 300 may calculate the gamma compensation value by reflecting all the luminance characteristic values that correspond to the unit sections between the reference gray level and the expected correction gray level.

As described with reference to FIGS. 4 to 7, the luminance compensating apparatus 300 may determine the luminance characteristic values reflected in calculating the gamma compensation value based on the unit section in which the expected correction gray level is included. Accordingly, the luminance compensating apparatus 300 may accurately calculate the gamma compensation value for calculating the compensation gray level GCV. Therefore, the display quality of the display panel 110 can be improved by effectively and accurately compensating for luminance of the display unevenness.

FIGS. 8A and 8B are examples of tables for calculating a luminance characteristic value of the luminance compensating apparatus 300 of FIG. 1. In FIGS. 8A and 8B, imaging gray levels (or reference gray levels) may indicate gray level values corresponding to the reference image data RID that is supplied by the luminance compensating apparatus 300 to the display panel 110, and gray levels to be corrected may indicate gray level values in which the luminance compensating apparatus 300 calculates the expected correction gray level and the gamma compensation value based on the imaging gray levels to calculate the compensation gray level GCV.

First, referring to FIGS. 1 and 8A, the luminance compensating apparatus 300 may supply 6 reference image data RID corresponding to 6 reference gray levels, for example, 32 gray levels, 64 gray levels, 96 gray levels, 128 gray levels, 196 gray levels, and 224 gray levels, to the display panel 110. Accordingly, the imaging unit 200 may capture 6 reference images displayed on the display panel 110 and generate 6 captured image data CID.

The luminance characteristic value calculator 330 of the luminance compensating apparatus 300 may calculate the luminance characteristic value corresponding to one unit section based on the captured image data CID corresponding to two of the 6 reference gray levels.

For example, the luminance characteristic value calculator 330 of the luminance compensating apparatus 300 may calculate the luminance characteristic value corresponding to the unit section between 32 to 63 gray levels based on the captured image data CID corresponding to 32 gray levels and 64 gray levels, calculate the luminance characteristic value corresponding to the unit section between 64 to 95 gray levels based on the captured image data CID corresponding to 64 gray levels and 96 gray levels, calculate the luminance characteristic value corresponding to the unit section between 96 to 127 gray levels based on the captured image data CID corresponding to 96 gray levels and 128 gray levels, calculate the luminance characteristic value corresponding to the unit section between 128 to 195 gray levels based on the captured image data CID corresponding to 128 gray levels and 196 gray levels, and calculate the luminance characteristic value corresponding to the unit section between 196 to 223 gray levels based on the captured image data CID corresponding to 196 gray levels and 224 gray levels.

In another example in which the expected correction gray level corresponding to the gray level to be corrected is less than or equal to 31 gray levels, the luminance compensating apparatus 300 may calculate the gamma compensation value by using the luminance characteristic value corresponding to the unit section between 32 to 63 gray levels. In yet another example in which the expected correction gray level corresponding to the gray level to be corrected is 225 gray levels or more, the luminance compensating apparatus 300 may calculate the gamma compensation value using the luminance characteristic value corresponding to the unit section between 196 to 223 gray levels. However, in these cases, in calculating the gamma compensation value, luminance characteristic in a low gray level region of 31 gray levels or less and a high gray level region of 225 gray levels or more may not be accurately reflected.

In an embodiment, the luminance compensating apparatus 300 may maintain the number of gray levels to be corrected for calculating the gamma compensation value, but increase the number of imaging gray levels (or reference gray levels). By reflecting the luminance characteristics in the low gray level region and the high gray level region, the gamma compensation value in the low gray level region and the high gray level region can be more accurately calculated.

Referring to FIGS. 1 and 8B, in order to reflect the luminance characteristic of the low gray level region, the luminance compensating apparatus 300 may further supply the reference image data RID corresponding to 16 gray levels that is smaller than the lowest gray level (i.e., 32 gray levels) of the example described with reference to FIG. 8A. Accordingly, the imaging unit 200 may capture the captured image data CID corresponding to the 16 gray levels. The luminance characteristic value calculator 330 of the luminance compensating apparatus 300 may calculate the luminance characteristic value corresponding to the unit section between 16 to 31 gray levels based on the captured image data CID corresponding to the two reference gray levels (i.e., 16 gray levels and 32 gray levels) of the low gray level region. Accordingly, in a case where the expected correction gray level corresponding to the gray level to be corrected is the 31 gray levels or less, the luminance compensating apparatus 300 may calculate the gamma compensation value using the luminance characteristic value corresponding to the unit section between 16 to 31 gray levels for calculating the compensation gray level GCV.

In addition, in order to reflect the luminance characteristic of the high gray level region, the luminance compensating apparatus 300 may further supply the reference image data RID corresponding to 240 gray levels that is larger than the highest gray level (i.e., 224 gray levels) of the example described with reference to FIG. 8A. Accordingly, the imaging unit 200 may capture the captured image data CID corresponding to the 240 gray levels. The luminance characteristic value calculator 330 of the luminance compensating apparatus 300 may calculate the luminance characteristic value corresponding to the unit section between 224 to 239 gray levels based on the captured image data CID corresponding to the two reference gray levels (i.e., 224 gray levels and 240 gray levels) of the high gray level region. Accordingly, in a case where the expected correction gray level corresponding to the gray level to be corrected is the 225 gray levels or greater, the luminance compensating apparatus 300 may calculate the gamma compensation value using the luminance characteristic value corresponding to the unit section between 224 to 239 gray levels for calculating the compensation gray level GCV.

As described above, the luminance compensating apparatus 300 may further calculate the luminance characteristic value of the unit section corresponding to the low gray level region and the high gray level region. Accordingly, the luminance characteristics of the low gray level region and the high gray level region may be accurately reflected in calculating the gamma compensation value, and the luminance compensating apparatus 300 can more accurately calculate the gamma compensation value of the low gray level region and the gamma compensation value of the high gray level region.

In addition, since the number of gray levels to be corrected is maintained, the memory capacity for calculating the expected correction gray level of the expected correction gray level calculator 340 and the compensation gray level GCV of the compensation gray level calculator 350 may not need to be increased. Therefore, the luminance compensating apparatus 300 may more accurately calculate the gamma compensation value of the low gray level region and the gamma compensation value of the high gray level region without increasing the memory capacity.

Figure 9:
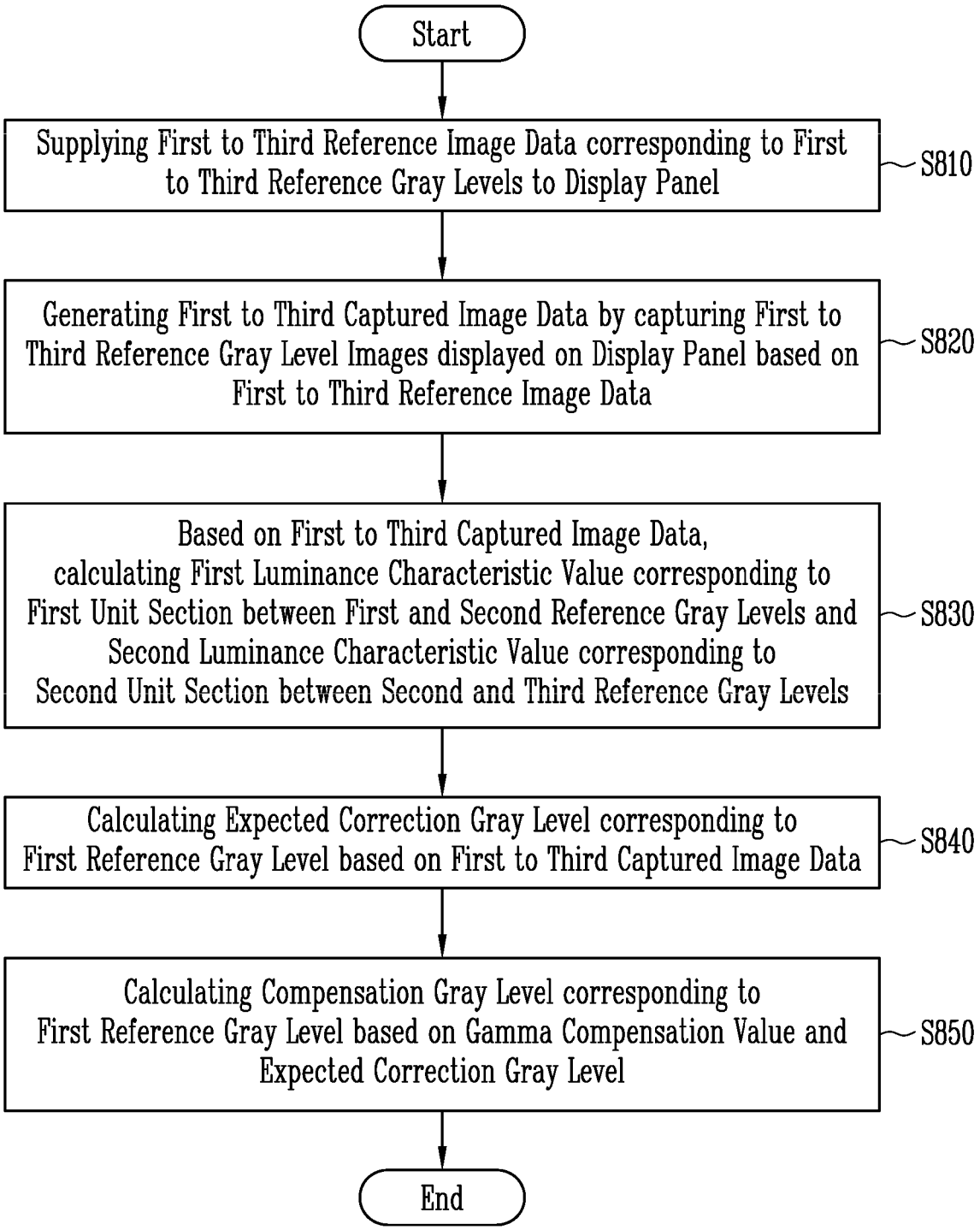
FIG. 9 is a flowchart illustrating a method of compensating luminance according to an embodiment of the present disclosure.

FIG. 9 is a flowchart illustrating a method of compensating luminance according to an embodiment of the present disclosure.

Referring to FIGS. 1 and 9, the display system 1000 of FIG. 1 may perform a method of compensating luminance of FIG. 9. The method of FIG. 9 may be substantially the same as the operation of the display system 1000 (and/or the luminance compensating apparatus 300) described with reference to FIGS. 1 to 8B, and thus duplicate description will be omitted.

First, the method of FIG. 9 may supply first to third reference image data (an example of the reference image data RID) corresponding to the first to third reference gray levels to the display panel 110 (S810). Here, the configuration for supplying the reference image data RID (S810) may be substantially the same as the configuration in which the reference image data supplier 310 of the luminance compensating apparatus 300 supplies the reference image data RID to the display panel 110 as described with reference to FIGS. 1 and 4 to 8B. Meanwhile, as described with reference to FIG. 1, the number of reference gray levels in the method of FIG. 9 may not be limited to the three reference gray levels. The method of FIG. 9 may supply the reference image data corresponding to four or more reference gray levels.

Thereafter, the method of FIG. 9 may capture first to third reference gray level images displayed on the display panel 110 based on the first to third reference image data to generate first to third captured image data (S820). Here, the configuration for capturing the reference gray level images to generate the captured image data (S820) may be substantially the same as the configuration of the imaging unit 200 that captures the image displayed on the display panel 110 to measure the luminance and generates the captured image data CID based on the reference image data RID as described with reference to FIGS. 1 and 4 to 8B.

Thereafter, the method of FIG. 9 may calculate the first luminance characteristic value corresponding to the first unit section between the first and second reference gray levels and calculate the second luminance characteristic value corresponding to the second unit section between the second and third reference gray levels based on the first to third captured image data (S830). Here, the configuration for calculating the first and second luminance characteristic values (S830) may be substantially the same as the configuration of the luminance compensating apparatus 300 that calculates the luminance characteristic values (e.g., the first luminance characteristic value $\gamma 1$, the second luminance characteristic value $\gamma 2$, and the like) as described with reference to FIGS. 1 and 4 to 8B.

Thereafter, the method of FIG. 9 may calculate the expected correction gray level corresponding to the first reference gray level based on the first to third captured image data (S840). Here, the configuration for calculating the expected correction gray level (S840) may be substantially the same as the configuration of the luminance compensating apparatus 300 that calculates the expected correction gray level (e.g., the first expected correction gray level gt1, the second expected correction gray level gt2, and the like) as described with reference to FIGS. 1 and 4 to 8B.

Thereafter, the method of FIG. 9 may calculate the compensation gray level GCV corresponding to the first reference gray level based on the gamma compensation value and the expected correction gray level (S850). Here, the configuration for calculating the compensation gray level GCV (S850) may be substantially the same as the configuration of the luminance compensating apparatus 300 that calculates the compensation gray level GCV as described with reference to FIGS. 1 and 4 to 8B.

In an embodiment, in a case where the expected correction gray level is included in the first unit section, the method of FIG. 9 may determine the first luminance characteristic value as the gamma compensation value. In another case where the expected correction gray level is included in the second unit section, the method of FIG. 9 may determine the gamma compensation value based on the first luminance characteristic value and the second luminance characteristic value.

The luminance compensating apparatus 300 according to the embodiments of the present disclosure may determine the luminance characteristic values reflected in calculating the gamma compensation value based on the unit section in which the expected correction gray level is included. Therefore, the display quality of the display panel 110 can be improved by accurately calculating the gamma compensation value for optical compensation.

However, the effects of the present disclosure are not limited to the above-described effects, and may be variously extended without departing from the spirit and scope of the present disclosure.

The foregoing may illustrate and provide detailed description of the present disclosure with reference to example embodiments. As described above, the present disclosure may be used in various different combinations, modifications and environments, and may be changed or modified within the scope of the inventive concept of the present disclosure, the scope equivalent to the above-described description, and/or the scope of technology or knowledge of the art. Therefore, the foregoing description is not intended to limit the present disclosure to the forms disclosed herein. Also, it is intended that the appended claims be construed to include alternative embodiments of the present disclosure.

What is claimed is:

1. A luminance compensating apparatus comprising:

a luminance characteristic value calculator calculating a first luminance characteristic value corresponding to a first unit section between a first reference gray level and a second reference gray level, and a second luminance characteristic value corresponding to a second unit section between the second reference gray level and a third reference gray level based on at least one or more of a first luminance value corresponding to the first reference gray level, a second luminance value corresponding to the second reference gray level that is greater than the first reference gray level, and a third luminance value corresponding to the third reference gray level that is greater than the second reference gray level;

an expected correction gray level calculator calculating an expected correction gray level corresponding to the first reference gray level based on the first luminance value; and an expected correction gray level calculator calculating an expected correction gray level corresponding to the first reference gray level based on the first luminance value; and a compensation gray level calculator calculating a gamma compensation value corresponding to the first reference gray level differently based on the expected correction gray level being in the first unit section or out of the first unit section, and further calculating a first compensation gray level corresponding to the first reference gray level based on the gamma compensation value and the expected correction gray level, wherein the compensation gray level calculator calculates a first gamma compensation value as the gamma compensation value based on the first luminance characteristic value in a first case where the expected correction gray level is included in the first unit section, and calculates a second gamma compensation value that is different from the first gamma compensation value as the gamma compensation value based on the first luminance characteristic value and the second luminance characteristic value in a second case where the expected correction gray level is included in the second unit section, wherein in the second case, the compensation gray level calculator calculates the gamma compensation value by a first equation of:

$$\gamma t = \frac{\gamma 2 \cdot \ln(gt/g2) + \gamma 1 \cdot \ln(g2/g1)}{\ln(gt/g1)}$$

wherein γt represents the gamma compensation value, γ1 represents the first luminance characteristic value, γ2 represents the second luminance characteristic value, g1 represents the first reference gray level, g2 represents the second reference gray level, and gt represents the expected correction gray level, and wherein the luminance characteristic value calculator calculates the first luminance characteristic value and the second luminance characteristic value by a second equation of:

$$\gamma 1 = \frac{\ln(L1/L2)}{\ln(g1/g2)}, \gamma 2 = \frac{\ln(L2/L3)}{\ln(g2/g3)}$$

wherein γ1 represents the first luminance characteristic value, γ2 represents the second luminance characteristic value, L1 represents the first luminance value, L2 represents the second luminance value, L3 represents the third luminance value, g1 represents the first reference gray level, g2 represents the second reference gray level, and g3 represents the third reference gray level.

2. The luminance compensating apparatus of claim 1, wherein the luminance characteristic value calculator calculates the first luminance characteristic value based on the first luminance value and the second luminance value, and the second luminance characteristic value based on the second luminance value and the third luminance value.

3. The luminance compensating apparatus of claim 1, wherein the expected correction gray level calculator calculates a luminance compensation ratio based on a difference between the first luminance value and a first luminance target value that corresponds to the first reference gray level.

4. The luminance compensating apparatus of claim 3, wherein the expected correction gray level calculator calculates the luminance compensation ratio by a third equation of:

$$LCR = \frac{LT - L1}{L1}$$

wherein LCR represents the luminance compensation ratio, LT represents the first luminance target value, and L1 represents the first luminance value.

5. The luminance compensating apparatus of claim 3, wherein the expected correction gray level calculator calculates the expected correction gray level by a fourth equation of:

$$gt = g1 \times (1 + LCR)^{\frac{1}{22}}$$

wherein gt represents the expected correction gray level, g1 represents the first reference gray level, and LCR represents the luminance compensation ratio.

6. The luminance compensating apparatus of claim 3, wherein the compensation gray level calculator calculates the first compensation gray level by a fifth equation of:

$$gcv = g1 \times (LCR)^{\frac{1}{\gamma t}}$$

wherein gcv represents the first compensation gray level, g1 represents the first reference gray level, LCR represents the luminance compensation ratio, and γt represents the gamma compensation value.

7. The luminance compensating apparatus of claim 1, wherein the luminance characteristic value calculator further calculates a third luminance characteristic value corresponding to a third unit section between the third reference gray level and a fourth reference gray level based on the third luminance value and a fourth luminance value corresponding to the fourth reference gray level that is greater than the third reference gray level, and wherein the compensation gray level calculator calculates a third gamma compensation value that is different from the first gamma compensation value and the second gamma compensation value as the gamma compensation value based on the first luminance characteristic value, the second luminance characteristic value, and the third luminance characteristic value in a third case where the expected correction gray level is included in the third unit section.

8. The luminance compensating apparatus of claim 7, wherein in the third case, the compensation gray level calculator calculates the gamma compensation value by a sixth equation of:

$$\gamma t = \frac{\gamma 3 \cdot \ln(gt/g3) + \gamma 2 \cdot \ln(g3/g2) + \gamma 1 \cdot \ln(g2/g1)}{\ln(gt/g1)}$$

wherein γt represents the gamma compensation value, γ1 represents the first luminance characteristic value, γ2 represents the second luminance characteristic value, γ3 represents the third luminance characteristic value, g1 represents the first reference gray level, g2 represents the second reference gray level, g3 represents the third reference gray level, and gt represents the expected correction gray level.

9. The luminance compensating apparatus of claim 1, wherein the compensation gray level calculator further calculates a second compensation gray level that corresponds to the second reference gray level and a third compensation gray level that corresponds to the third reference gray level, and calculates compensation gray levels that correspond to an entire gray level region by applying a linear interpolation and/or extrapolation method to the first, second, and third compensation gray levels.

10. A display system comprising:

a luminance compensating apparatus providing a first reference image data, a second reference image data, and a third reference image data corresponding to a first reference gray level, a second reference gray level, and a third reference gray level, respectively;

a display panel displaying a first reference gray level image, a second reference gray level image, and a third reference gray level image based on the first, second, and third reference image data; and an imaging unit capturing the first, second, and third reference gray level images, generating a first captured image data, a second captured image data, and a third captured image data, and providing the first, second, and third captured image data to the luminance compensating apparatus, wherein the luminance compensating apparatus includes:

a luminance characteristic value calculator calculating a first luminance characteristic value corresponding to a first unit section between the first and second reference gray levels based on the first and second captured image data, and calculating a second luminance characteristic value corresponding to a second unit section between the second and third reference gray levels based on the second and third captured image data;

an expected correction gray level calculator calculating an expected correction gray level corresponding to the first reference gray level based on the first captured image data; and a compensation gray level calculator calculating a gamma compensation value corresponding to the first reference gray level differently based on the expected correction gray level being in the first unit section or out of the first unit section, and further calculating a compensation gray level corresponding to the first reference gray level based on the gamma compensation value and the expected correction gray level, wherein the compensation gray level calculator calculates a first gamma compensation value as the gamma compensation value based on the first luminance characteristic value in a first case where the expected correction gray level is included in the first unit section, and calculates a second gamma compensation value that is different from the first gamma compensation value as the gamma compensation value based on the first luminance characteristic value and the second luminance characteristic value in a second case where the expected correction gray level is included in the second unit section, wherein in the second case, the compensation gray level calculator calculates the gamma compensation value by a first equation of:

$$\gamma t = \frac{\gamma 2 \cdot \ln(gt/g2) + \gamma 1 \cdot \ln(g2/g1)}{\ln(gt/g1)}$$

wherein γt represents the gamma compensation value, γ1 represents the first luminance characteristic value, γ2 represents the second luminance characteristic value, g1 represents the first reference gray level, g2 represents the second reference gray level, and gt represents the expected correction gray level, and wherein the luminance characteristic value calculator calculates the first luminance characteristic value and the second luminance characteristic value by a second equation of:

$$\gamma 1 = \frac{\ln(L1/L2)}{\ln(g1/g2)}, \gamma 2 = \frac{\ln(L2/L3)}{\ln(g2/g3)}$$

wherein γ1 represents the first luminance characteristic value, γ2 represents the second luminance characteristic value, L1 represents a first luminance value, L2 represents a second luminance value, L3 represents a third luminance value, g1 represents the first reference gray level, g2 represents the second reference gray level, and g3 represents the third reference gray level.

11. The display system of claim 10, wherein the luminance compensating apparatus further includes a reference image data supplier supplying the first, second, and third reference image data to the display panel.

12. The display system of claim 10, wherein the display panel includes a plurality of pixels, and wherein the compensation gray level calculator calculates the compensation gray level for each of the plurality of pixels.

13. The display system of claim 10, wherein the display panel includes a plurality of unit blocks, and each of the plurality of unit blocks includes a plurality of pixels, and wherein the compensation gray level calculator calculates the compensation gray level for each of the plurality of unit blocks.

14. A method of compensating luminance of a display panel comprising:

providing a first reference image data, a second reference image data, and a third reference image data corresponding to a first reference gray level, a second reference gray level, and a third reference gray level to the display panel;

generating a first captured image data, a second captured image data, and a third captured image data by capturing a first reference gray level image, a second reference gray level image, and a third reference gray level image displayed on the display panel based on the first, second, and third reference image data;

calculating a first luminance characteristic value corresponding to a first unit section between the first and second reference gray levels, and a second luminance characteristic value corresponding to a second unit section between the second and third reference gray levels based on the first, second, and third captured image data;

calculating an expected correction gray level corresponding to the first reference gray level based on the first, second, and third captured image data;

calculating a gamma compensation value corresponding to the first reference gray level differently based on the expected correction gray level being in the first unit section or out of the first unit section; and calculating a compensation gray level corresponding to the first reference gray level based on the gamma compensation value and the expected correction gray level, wherein the calculating the compensation gray level includes:

calculating a first gamma compensation value as the gamma compensation value based on the first luminance characteristic value in a first case where the expected correction gray level is included in the first unit section; and calculating a second gamma compensation value that is different from the first gamma compensation value as the gamma compensation value based on the first luminance characteristic value and the second luminance characteristic value in a second case where the expected correction gray level is included in the second unit section, wherein in the second case, a compensation gray level calculator calculates the gamma compensation value by a first equation of:

$$\gamma t = \frac{\gamma 2 \cdot \ln(gt/g2) + \gamma 1 \cdot \ln(g2/g1)}{\ln(gt/g1)}$$

wherein γt represents the gamma compensation value, γ1 represents the first luminance characteristic value, γ2 represents the second luminance characteristic value, g1 represents the first reference gray level, g2 represents the second reference gray level, and gt represents the expected correction gray level, and wherein a luminance characteristic value calculator calculates the first luminance characteristic value and the second luminance characteristic value by a second equation of:

$$\gamma 1 = \frac{\ln(L1/L2)}{\ln(g1/g2)}, \gamma 2 = \frac{\ln(L2/L3)}{\ln(g2/g3)}$$

wherein γ1 represents the first luminance characteristic value, γ2 represents the second luminance characteristic value, L1 represents a first luminance value, L2 represents a second luminance value, L3 represents a third luminance value, g1 represents the first reference gray level, g2 represents the second reference gray level, and g3 represents the third reference gray level.

15. The method of claim 14, wherein the first captured image data includes the first luminance value displayed on the display panel corresponding to the first reference gray level.

16. The method of claim 15, wherein the calculating the expected correction gray level includes:

calculating a luminance compensation ratio based on a difference between the first luminance value and a first luminance target value that corresponds to the first reference gray level; and calculating the expected correction gray level based on the luminance compensation ratio.

* * * * *